United States Patent [19]

Jacobs et al.

[11] Patent Number: 4,608,536

[45] Date of Patent: Aug. 26, 1986

[54] IGNITION PERFORMANCE MEASURING CIRCUIT

[76] Inventors: Aaron R. Jacobs, 5821 Lakehaven Way, Yorba Linda, Calif. 92686; John W. Gustafson, 2121 Valderas Dr., Apt. #64, Glendale, Calif. 91208

[21] Appl. No.: 657,389

[22] Filed: Oct. 3, 1984

[51] Int. Cl.[4] ..... F02P 17/00; F02P 15/08

[52] U.S. Cl. ..... 324/399; 324/384; 324/378; 123/638; 73/116

[58] Field of Search ..... 324/378, 384, 392, 399; 123/638, 310; 73/116, 119 A

[56] References Cited

U.S. PATENT DOCUMENTS

| | | | |
|---|---|---|---|
| 3,409,824 | 11/1968 | Makuh | 324/384 |
| 3,961,240 | 6/1976 | Pohl | 324/399 |
| 4,417,467 | 11/1983 | Higgs | 324/378 |

*Primary Examiner*—Reinhard J. Eisenzopf
*Assistant Examiner*—Jose M. Solis
*Attorney, Agent, or Firm*—James F. Kirk

[57] ABSTRACT

The Ignition Performance Measuring Circut is intended for use with dual ignition systems, such as the dual-magneto ignition systems used on light aircraft. The circuit has a first and second channel. The first channel is dedicated to measuring the relative peak amplitude of amplitude difference signals, i.e. the algebraic difference between concurrent left and right conditioned ignition signals. Signal conditioning is performed by an input attenuator and a difference amplifier. The circuit operates without benefit of a positive synchronization. To any particular cylinder's ignition firing signals. The pilot of an aircraft using the invention circuit will be alerted to the presence of a degraded firing signal but will not be advised as to which cylinder or spark plug is contributing to the failure indication. The circuit has a peak detection network for selecting the largest amplitude difference signal from each series of firing signals. The second channel senses the time difference between concurrent left and right firing signals for the purpose of detecting timing errors between the left and right ignition systems. The circuit is intended to couple to the ignition system at the ignition selector switch thereby eliminating the necessity for disturbing existing shielded or armored sealed existing ignition system components.

25 Claims, 5 Drawing Figures

IGNITION PERFORMANCE MEASURING CIRCUIT

BACKGROUND OF THE INVENTION

1. Field of the Invention

This invention relates to the field of aircraft engine performance monitoring systems and more particularly to the field of portable or on-board test circuits used to measure the performance of the dual ignition systems. Such systems include the dual magneto powered ignition systems customarily used on reciprocating internal combustion engines such as the engines used to power light aircraft, hydroplane boats and power carts and other vehicles requiring the use of high engine power to weight ratio.

2. Description of the Prior Art

There are no known Ignition Performance Measuring Circuits for use as on-board monitoring circuits for light aircraft. Engines using a dual ignition system typically obtain maximum performance when each of the separate ignition systems are timed to provide simultaneous ignition signals in correct synchronization with the engine timing cycle. Pilots operating aircraft equipped with dual magneto ignition systems are instructed to test these systems prior to taking off by bringing the engine RPM to a predetermined level, and individually switching each magneto off while monitoring the engine RPM for an expected and limited drop of typically less than five percent. Aircraft ignition systems are not tested in flight.

There is no presently known equipment available for use on light aircraft in flight for continuously monitoring for the loss of one half of a dual magneto powered ignition system not for monitoring for a defective ignition signal to a particular spark plug since the remaining operational spark plug in the cylinder will fire the cylinder thereby preventing a cylinder miss that the pilot or operator could hear. The present procedure for checkout prior to flight allows a pilot to detect a miss firing spark plug only as the alternate ignition system is switched off by observing that one cylinder is missing from the firing order. An accompanying loss of engine RPM will also be observed. However; once both ignition systems are activated, as in flight, the pilot is again without means for detecting the loss of a firing signal in a cylinder in which the alternate ignition system is functioning since the power loss would be minimal.

Degradation of the ignition system is more likely to go un-noticed where different pilots use the aircraft such as is customary with club-owned aircraft or where the aircraft is subject to infrequent use. An un-noticed loss or partial loss of an ignition system can result in a hazardous condition for both pilot and passengers.

Ignition systems used on aircraft are typically shielded making electrical contact with the individual firing circuits impractical. Aircraft magnetos are typically sealed making contact at the magneto impractical. Establishing a timing reference is also impossible without mechanically invading the magneto housing, the shielded or armored individual ignition leads, the engine shaft gearing or by resorting to external sensors for monitoring the location of the moving propeller. The expense of incorporating an ignition performance monitoring circuit using conventional means for coupling signals from the ignition system to the test circuit is substantial and typically operates to discourage consideration of solutions to the performance monitoring problem.

SUMMARY OF THE INVENTION

It is a major objective of this invention to provide an Ignition Performance Measuring Circuit that couples to newly manufactured or existing aircraft ignitions system at a convenient and safe location within the cockpit; thereby, obviating the need for coupling the invention measuring circuit to the system at points requiring mechanical alteration of existing aircraft hardware such as the magnetos or the armored ignition cables presently used.

It is another objective of this invention Ignition Performance Measuring Circuit to provide a standard circuit capable of providing an operator or pilot with a signal indicating that ignition degradation has occurred or in the alternative, two signals; the first indicating irregularity in the amplitude of successive firing signals and a second indicating the relative difference in timing between corresponding and relatively simultaneous ignition firing signals.

It is another object of this invention to provide a design requiring very low power consumption and one capable of being easily and quickly and inexpensively configured and self calibrated on the aircraft by the installer for any conventional number of cylinders at the time of installation and without the use of sophisticated external test circuitry or add on circuitry.

It is yet another object of the invention to provide the operator with a signal indicating the measure of degradation that has taken place with respect to a predetermined reference level established at a point in time where operator confidence in engine calibration and performance is high, such as at periodic inspection intervals.

The invention Ignition Performance Measuring Circuit is a circuit intended for use with dual ignition systems. The invention circuit has a first and second channel. The first channel is dedicated to measuring the relative peak amplitude of amplitude difference signals, i.e. the algebraic difference between concurrent left and right conditioned ignition signals.

Signal conditioning is performed by an input attenuator and a difference amplifier having a predetermined gain. The circuit is intended to operate without benefit of a positive synchronization means in that the circuit will minitor firing signals as they occur in sequence without regard to which signal is related to any particular cylinder's ignition firing signals. The pilot of an aircraft using the invention circuit will be alerted to the presence of a degraded firing signal but will not be advised advised as to which cylinder or spark plug is contributing to the failure indication. The circuit has a peak detection network for selecting the largest amplitude difference signal from each series of firing signals.

The invention circuit also contains a second channel for sensing the time difference between concurrent left and right firing signals for the purpose of detecting timing errors between the left and right ignition systems.

The circuit is intended to mount within an aircraft cockpit and to couple to the ignition system at the ignition selector switch thereby eliminating the necessity for disturbing existing armored and sealed existing ignition system components. Power to operate the circuit is provided by self contained batteries or from an existing aircraft battery source such as the aircraft service battery.

BRIEF DESCRIPTION OF THE DRAWINGS

The invention will be further described as to an illustrative embodiment in conjunction with the accompanying drawings in which.

DESCRIPTION OF THE PREFERRED EMBODIMENT

Figure 1:
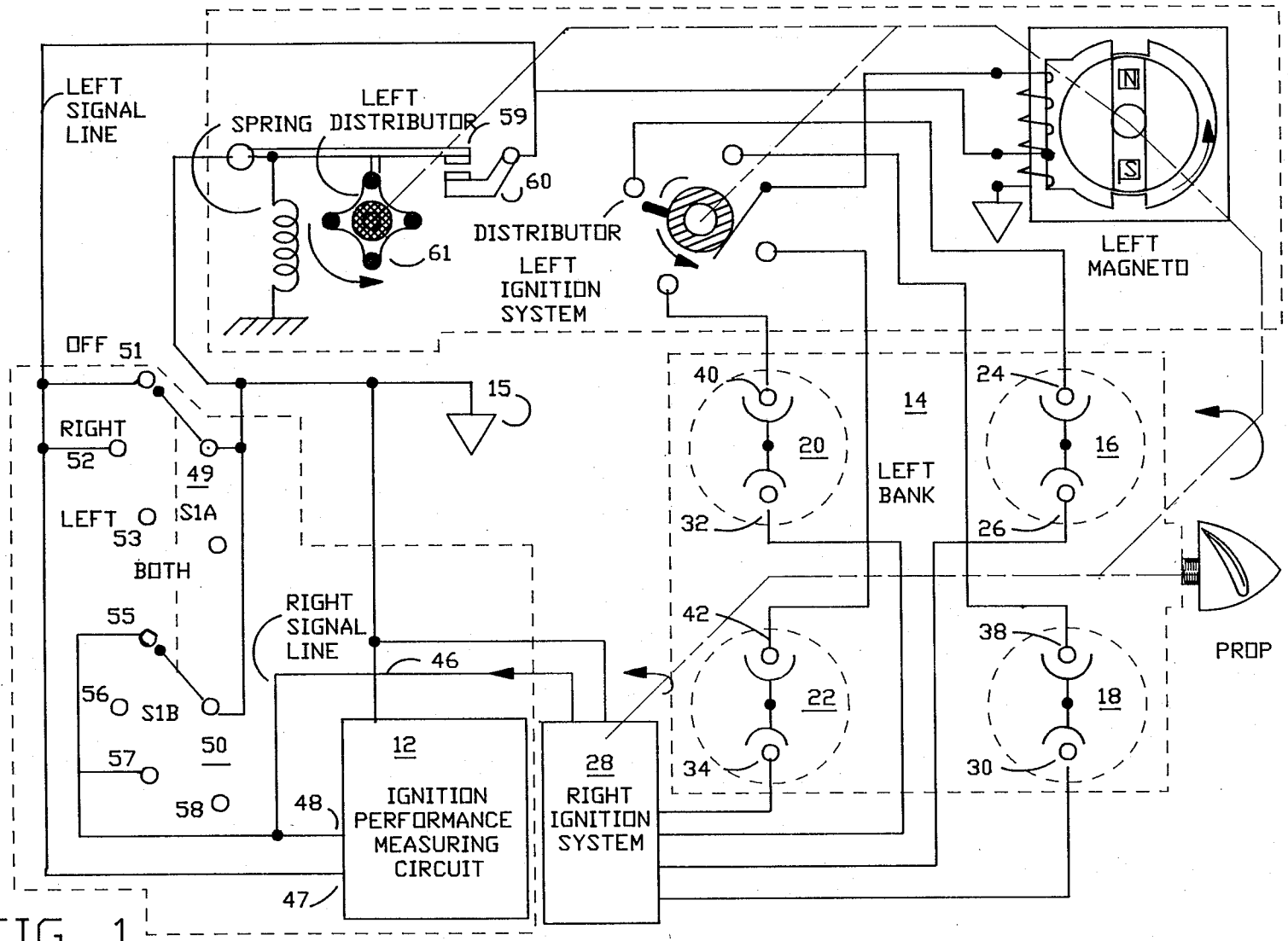
FIG. 1 is a combined schematic and block diagram showing the relationship between the invention circuit and an aircraft ignition system.

In accordance with the present invention, FIG. 1 is a combined schematic and block diagram of a dual ignition system 10 adapted to use the invention Ignition Performance Measuring Circuit represented by block 12 showing the invention circuit coupled to a reciprocating internal combustion engine depicted as phantom functional block 14 having a predetermined number of cylinders. The engine 14, is showh as having four cylinders represented by phantom circles 16, 18, 20 and 22 by way of example only. The invention monitor circuit represented by block 12 is easily adapted to operate with dual ignition systems used on engines having six, eight or even higher numbers of cylinder, and with engines having odd as well as even numbers of cylinders.

FIG. 1 depicts each cylinder as having a left and right spark plug such as 24 and 26 respectively. A right ignition system represented by functional block 28 provides ignition firing signals to each respective right spark plug 26, 30, 32 and 34 in a predetermined sequence.

A left ignition system represented by the schematic circuit within phantom block 36 provides ignition firing signals to each respective left spark plug 24, 38, 40, and 42 in a predetermined sequence.

Figure 2:
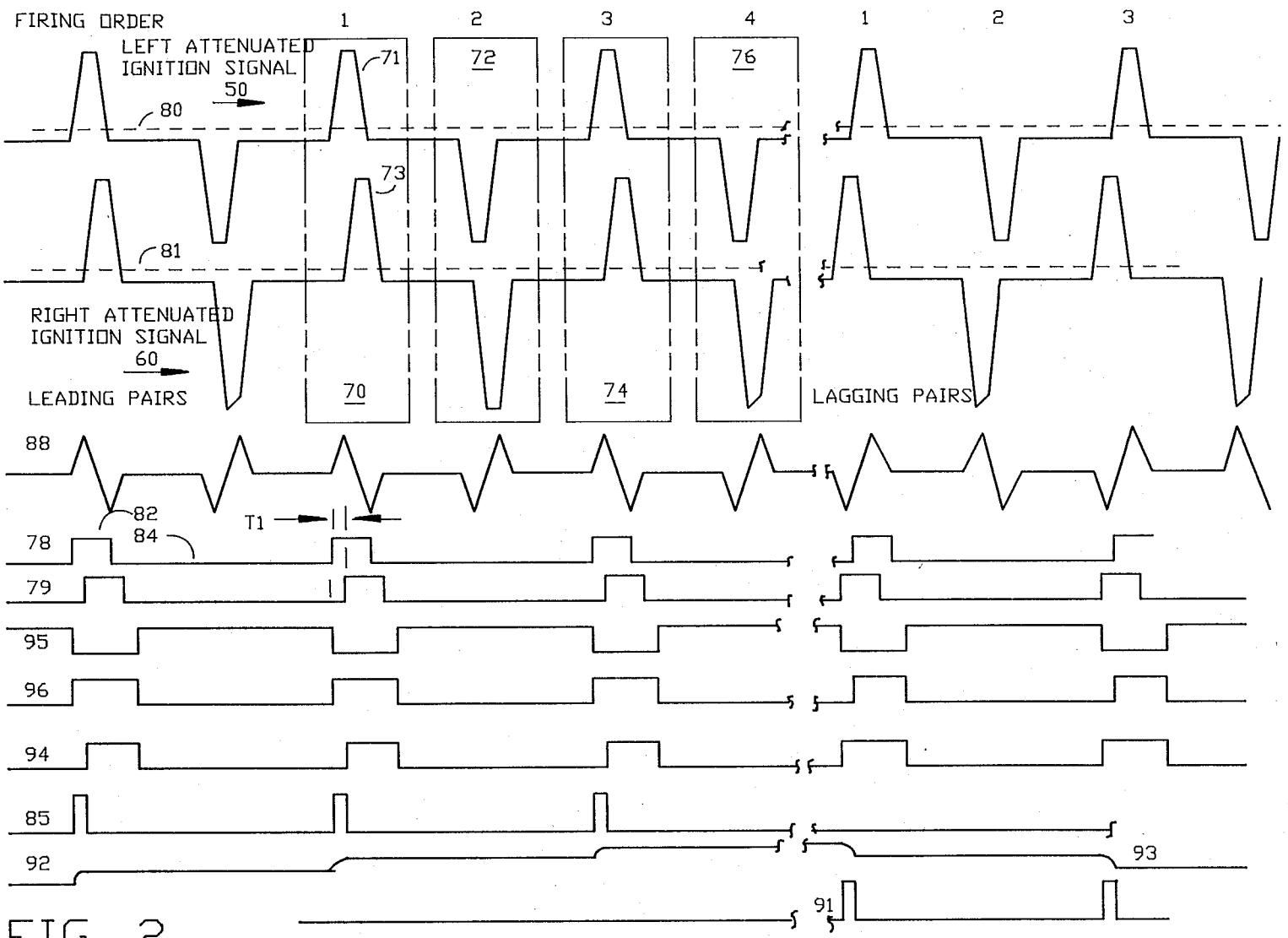
FIG. 2 is a timing diagram that schematically characterizes the timing relationship between signals occurring within the invention circuit.

The left ignition system 36, has a left signal line, such a lead 44 for providing a left attenuated ignition signal such as that shown in FIG. 2 as the waveform 50. The right ignition system 28 has a right signal line 46 providing a right attenuated ignition signal such as that shown in FIG. 2 as waveform 60.

The attenuated left and right ignition signals, such as those shown as waveforms 50 and 60 in FIG. 2 form a recurrent series of relatively concurrent left and right attenuated ignition signal pairs, such as the pairs designated by phantom blocks 70, 72 74 and 76. The number of ignition signal pairs in a series correspond in number to a predetermined number, typically equivalent to the number of engine cylinders used by the engine. Four signal pairs, such as pairs 70, 72, 74 and 76 form a series of pairs as characterized in the example of FIG. 2.

Each respective left and right attenuated ignition signal, such as signals 71 and 73 correspond to the ignition firing signal (not shown) applied to the respective engine spark plugs such as those referenced in FIG. 1 as 40 and 32 respectively, in operation. The left and right attenuated ignition signals are typically 50 to 100 times smaller in amplitude than their corresponding ignition firing signals.

Figure 3:
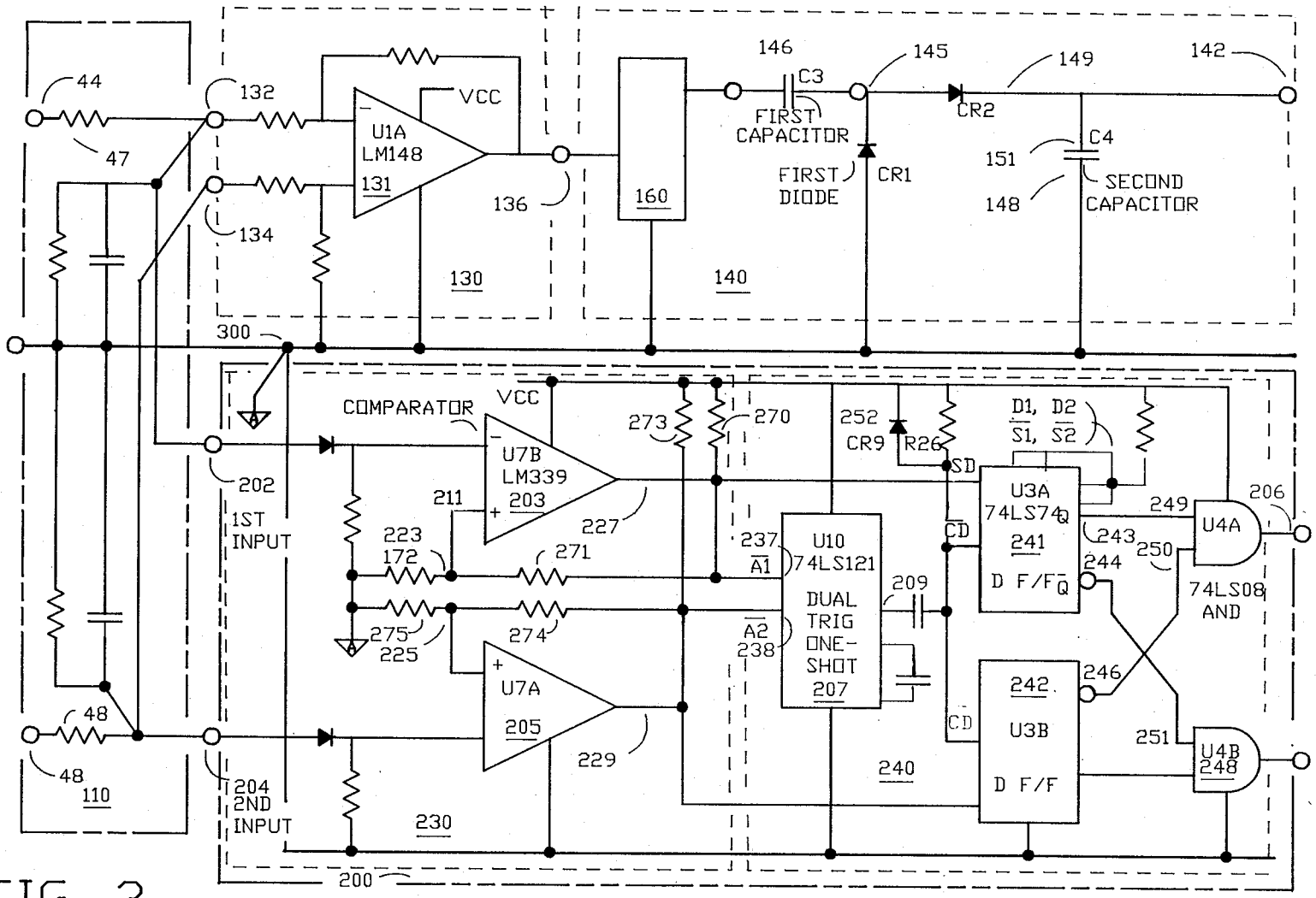
FIG. 3 is a partial schematic showing the first part of the first and second channel circuits.

Referring to FIG. 3, phantom block 110 is shown representing a means for conditioning and scaling the left and right attenuated ignition signals and for providing respective left and right conditioned attenuated ignition signals at nodes 132 and 134 respectively. The conditioned attenuated ignition signals are scaled in amplitude to be compatible with the subsequent circuitry and are filtered to eliminate signal information beyond the bandwidth of interest. The means for conditioning and scaling the left and right attenuated ignition signals 110 in FIG. 3 receives the left attenuated ignition signal 50 via line 44 (shown also in FIG. 1) at terminal 47 and the right attenuated ignition signal 60 via line 46 at terminal 48.

FIG. 3 shows a first channel means, represented by the circuitry within phantom block 130 and 140, having a first and second input, such as terminals 132 and 134 respectively. The first and second inputs at terminals 132, 134 are coupled respectively to the left and right conditioned attenuated ignition signals present at the outputs of phantom block 110. The circuit within phantom block 130 measures the relative peak amplitude of the algebraic difference between relatively concurrent left and right conditioned attenuated ignition signals at terminals 132 and 134 respectively and provides a repeating series of amplitude difference signals at 136. Each amplitude difference signal corresponds in sequence to a respective ignition signal pair 70, 72, 74, 76 and corresponds in peak amplitude to the algebraic difference between the left and right conditioned attenuated ignition signals at terminals 132 and 134 respectively that form the respective ignition signal pair.

The circuit within phantom block 140 in FIG. 3 represents a means responsive to the amplitude difference signal at terminal 136 for selecting the largest recurrent difference signal from the repeating recurrent series of AMPLITUDE difference signals, appearing at terminal 136 and for providing a series of largest amplitude difference signals at terminal 142 that correspond in amplitude to the largest recurrent difference signal that appears at 136.

Figure 4:
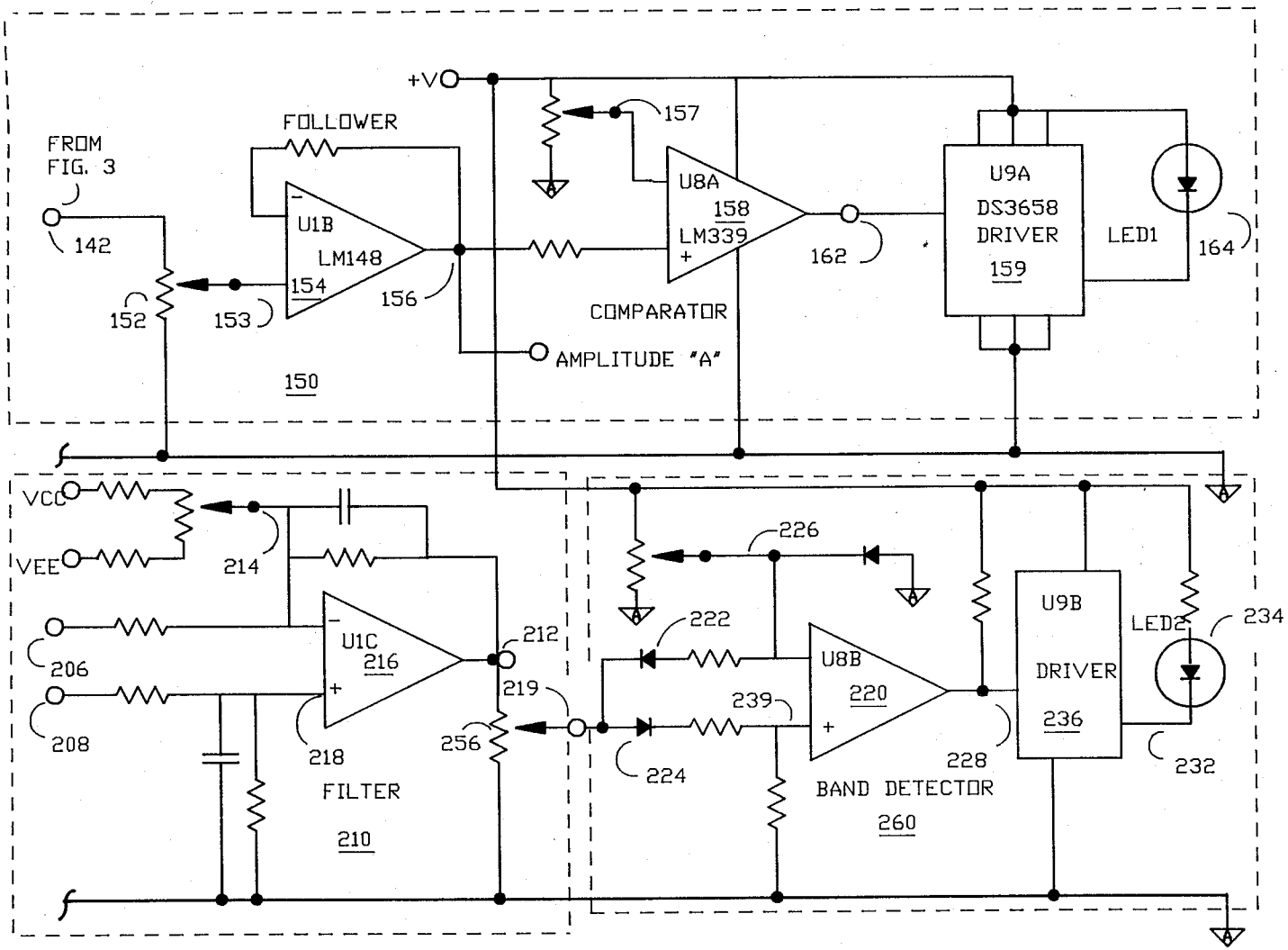
FIG. 4 is a partial schematic showing the remainder of the first and second channel circuits.

FIG. 4 shows phantom block 150 containing one embodiment of a circuit means responsive to the largest recurrent difference signal at terminal 142, for conditioning the series of largest amplitude difference signals at 142 and for scaling and for comparing the largest amplitude difference signal with a predetermined amplitude reference signal. Amplifier 154 amplifies and scales the signal from terminal 142 and also provides impedance matching. Comparator 158 receives the scaled output signal from 156 and compares it with the predetermined reference signal at terminal 157 derived from a precision reference +V and provides an ignition amplitude signal at terminal 162. The ignition amplitude signal at terminal 162 is coupled to the input of driver 159. Driver 159 responds to the signal at terminal 159 by providing an output signal to light LED 164 in response to a signal at terminal 162.

FIG. 3 also shows a second channel means characterized by the schematic within phantom block 200 having first and second inputs 202 and 204 coupled respectively to the left and right conditioned attenuated ignition signals appearing at 132 and 134 for measuring the relative time difference between the left and right conditioned attenuated ignition signals, and for providing a repeating series of phase difference signals at 206 and 208 each phase difference signal corresponding to the time difference between relatively concurrent left and right conditioned attenuated ignition signals at 132 and 134.

FIG. 4 shows a circuit within phantom block 210 coupled to terminals 206 and 208 that represents a means responsive to the repeating series of phase difference signals at 206 and 208 for averaging and scaling the repeating series of phase difference signals and that provides a phase timing signal characterizing the averaged relative phase difference signal at 212 in relation to a predetermined phase reference signal, such as the reference voltage sensed at terminal 214. The second channel means circuit of phantom block 200 (as shown in FIG. 3) provides a series of pulses at either terminal 206 or 208 depending on which of the left and right conditioned attenuated ignition signals occurs first. With pulses at terminal 206, amplifier 216 is ground referenced at its positive input 218 and provides a filtered negative going response to the averaged relative phase difference signal terminal 212. With pulses at terminal 208, a positive going signal appears at 212.

A portion of the signal at terminal 212 is sensed at terminal 219. This signal is fed to the band detector circuit of amplifier 220. As the signal at terminal 219 rises to a level more positive than the predetermined reference at terminal 226, diode 222 is back biased, and the voltage at the negative input of amplifier 220 is established by the reference voltage at terminal 226. The voltage at terminal 219 forward biases diode 224. As the voltage at terminal 219 continues to rise, the voltage at the amplifier 220 positive input exceeds the reference level at the negative input and the output at terminal 228 goes positive toggling the output of driver 230 low at terminal 232 thereby lighting LED 234.

For alternate phase error signals in which the signal at terminal 219 goes negative, diode 224 becomes back biased allowing the positive input to the amplifier to be referenced to ground. As the signal at terminal 219 becomes more negative than ground, diode 222 is forward biased and pulls the negative input of the amplifier below ground. This condition also produces a positive amplifier output at terminal 228 and a corresponding warning light from LED 234.

Degradation in the dual ignition system is monitored by observing the magnitude of the amplitude signal at 156 indicating the difference between the largest amplitude difference signal at 142 and the predetermined amplitude reference signal at 157, and by observing the magnitude of the phase difference signal at 212 with respect to a predetermined phase reference signal such as the band reference voltage established by the predetermined voltage at terminal 226 and the ground reference voltage.

Referring again to FIG. 3, in a more particular embodiment of the invention circuit the first channel means 130 has a difference amplifier such as 131 having an inverting input such as 133 and a non-inverting input such as 135, and an output terminal coupled to 136. Each respective input is coupled to receive respective left and right conditioned attenuated ignition signals from 132 and 134 respectively. The difference amplifier 131 is characterized as amplifying the algebraic difference between the left and right conditioned attenuated ignition signals appearing at 132 and 134, and provides the amplitude difference signals (not shown) at the difference amplifier output terminal at 136.

FIG. 3 depicts, within phantom block 140, a particular alternative embodiment of the invention first channel means responsive to the amplitude difference signal at terminal 136 for selecting the largest recurrent difference signal from the repeating recurrent series of difference signals at terminal 136, and for providing a series of largest amplitude difference signals at terminal 142 corresponding in amplitude to the largest recurrent difference signal in each set of difference signals at terminal 136.

The first channel means 140 is shown having a first channel first and second capacitor, such as capacitors C3 and C4. Each respective first channel first and second capacitor has a first and second terminal.

The first channel means 140 also has a first channel first and second diode, such as CR1 and CR2 respectively. Each respective diode, CR1, CR2 has a cathode and anode terminal. The first diode cathode 143 and the second diode anode 144 are coupled to the first capacitor second terminal 145. The first capacitor first terminal 146 is coupled via the commutating circuit within phantom block 160 to the difference amplifier output terminal 136. In embodiments not requiring the selection of a particular recurring amplitude difference signal selected from each set of recurring amplitude difference signals, phantom block 160 is replaced with a conductor between amplifier output terminal 136 and first capacitor first terminal 146.

The first diode anode 147 and the second capacitor second terminal 148 are coupled to the reference potential, such as electrical ground 300. The second diode cathode 149 is coupled to the second capacitor first terminal 151. The largest recurrent difference signal is provided at the second capacitor first terminal 151, is filtered by C4 and then coupled to terminal 142.

Referring to FIG. 4, the circuit within phantom block 150 shows one enablement of a means for monitoring the value of the ignition amplitude signal. Amplifier 154 scales the largest amplitude difference signal at node 142 and couples it to comparator circuit 158 for comparison with a predetermined reference voltage at node 157. LED 164 is turned on by a driver 159 in response to a signal at node 162 indicating that the signal at node 156 has exceeded the reference voltage at node 157. The signal at 156 could also be displayed using analogue instruments or could be digitized for surveillance by a digital surveillance system. The terminal designated AMPLITUDE "A" is for this purpose.

FIGS. 3 and 4 show the second channel means within phantom blocks 200 in FIG. 3 and within phantom blocks 210 and 260 in FIG. 4. Referring to FIG. 3, the second channel means is shown having first and second inputs 202 and 204 coupled respectively to the left and right conditioned attenuated ignition signals at 132 and 134. The circuity of phantom block 110 in FIG. 3 provides a noise filtering and scaling function.

The second channel means measures the relative the relative time difference between the left and right conditioned attenuated ignition signals. Referring to FIG. 2, the timing relationship between and waveshapes of the left and right conditioned attenuated ignition signals are represented by the waveshapes 71 and 73 that depict a left and right attenuated ignition signal.

The signal waveforms within phantom block 70 show a relative time difference T1 between left and right conditioned attenuated ignition signals represented by wave shapes 71 and 73 respectively. The second channel means provides a timing signal characterizing the averaged relative phase between relatively concurrent left and right conditioned attenuated ignition signals in relation to a predetermined phase reference signal. Waveform 88 represents the amplitude difference signal present at node 136 in FIG. 3.

The circuit within phantom block 230 represents a means responsive to each relatively concurrent pair of left and right conditioned attenuated ignition signals at 202 and 204 for providing pairs of respective left and right threshold penetrating ignition signals at nodes 227 and 229 in response to the left and right conditioned attenuated ignition signals penetrating a predetermined threshold voltage, at nodes 223 and 225. The threshold voltages established at nodes 223 and 225 are set by respective resistor value networks 270, 271, 272 and 273, 274 and 275 biased from VCC, the supply voltage, typically +5 Vdc.

The circuit with phantom block 240 represents an embodiment of a means responsive to the left and right threshold penetrating ignition signals 78, 79 for providing exclusive leading logic phase difference signals 85 or lagging logic phase difference signals 91.

The circuit within phantom block 210 in FIG. 4 represents an alternative embodiment of a phase output circuit means responsive to the exclusive of leading logic phase difference signals, such as logic signal 85 in FIG. 2, for providing an averaged phase output signal of a first polarity, such as filtered wave form 92, and responsive to the repeating series of lagging logic phase output signals 91 for providing an averaged phase output signal of a second polarity, such as filtered wave form 93.

Referring to FIG. 4, the circuit within phantom block 260 represents an embodiment of a means for monitoring the averaged phase output signals 92 and 93 in relation to a predetermined acceptable limit band, such as the voltage between ground 300 and the voltage at node 226.

The operator obtains notice of relative timing error as a result of the indicator LED being turned on in the embodiment of the circuit within phantom block 260.

Referring again to FIGS. 2 and 3, the circuit within phantom block 230 that depicts a means responsive to each relatively concurrent pair of the left and right conditioned attenuated ignition signals. These signals are represented in FIG. 2 as 71, 73. They provide pairs of respective left and right threshold penetrating ignition signals represented by 78, 79, in response to the left and right conditioned attenuated ignition signals penetrating a predetermined threshold voltage such as 80 and 81 respectively.

The circuit within phantom block 230 has a first and second comparator circuit, such as 203 and 205. The first comparator circuit 203 has a signal input 210 coupled to the second channel means first input 202. The second comparator circuit 203 has a signal input 215 coupled to the second channel means second input 204. Each comparator circuit has a respective reference signal input 211, 213 coupled to a reference threshold voltage source 223, 225. These sources are derived from resistor divider networks from VCC to ground 300 and are scaled to provide the predetermined threshold voltage characterized in FIG. 2 as 80, 81 at nodes 223 and 225. First and second comparator circuits 203, 205 have respective output terminals 227, 229.

The first and second comparator circuits 203, 205 are characterized to provide respective left and right threshold penetrating ignition signals at each respective comparator output terminal 227, 229 as logic signals having a first logic state, shown in FIG. 2 as 82, in response to a respective left or right conditioned attenuated ignition signal at nodes 202 or 204 exceeding a predetermined reference threshold voltage source, such as the predetermined reference voltage at nodes 223 and 225 respectively. The comparator output terminals 227, 229 provide a second logic state, shown in FIG. 2 as 84, in response to a respective left or right conditioned attenuated ignition signal voltage 71, 73 at its respective signal input not exceeding the predetermined reference threshold voltage 80, 81.

The means responsive to the left and right threshold penetrating ignition signals for providing respective exclusive leading logic phase difference signals or lagging logic phase difference signals characterized by the alternative embodiment of the circuit within phantom block 240 has a first and second "D" Flip-Flop-flop 241, 242. The first flip-flop 241 is set by the signal from the first comparator output terminal 227 and the second flip-flop 242 is set by a logic signal from the second comparator output terminal 229. Each respective flip-flop 241, 242 provides respective output signals, represented in FIG. 2 by waveforms 94 and 96, at respective uncomplimented and complemented output terminals 243, 244, 245, 246.

The FIG. 3 one-shot integrated circuit 207 is an embodiment of a reset circuit means responsive to the onset of the first of each left and right threshold penetrating ignition signals 78, 79 in each pair assuming a first logic state 82 for simultaneously resetting the first and second flip-flops 241, 242 after a predetermined time interval, such as that characterized in FIG. 2 by time delay waveform 94.

Flip-flops 241 and 242 have their inverted and noninverted outputs coupled to a logic circuit means, within phantom block 240. The logic circuit means is responsive to the first and second flip-flop outputs at nodes 243, 244, 245 and 246. The logic circuit means provides exclusive leading logic phase difference signals 85 or exclusive lagging logic phase difference signals 91. By "exclusive or" we mean that leading and lagging logic difference signals do not occur concurrently. Either leading or lagging signals occur in response to the occurrence of non-simultaneous left and right threshold penetrating ignition signals, but not both.

The phantom block 240 of FIG. 3 shows a particular embodiment of the logic circuit means circuit having a first and second logic gate, 247, 248. Each of the respective logic gates has a first and second input and an output terminal. The first logic gate first input 249 is coupled to the first flip-flop uncomplimented output terminal 243. The first logic gate second input 250 is coupled to the second flip-flop complemented output terminal 246. The second logic gate first input 251 is coupled to the first flip-flop complemented output terminal 244. The second logic second input 252 is coupled to the second flip-flop uncomplimented output 245. The first logic gate output terminal 206 provides the exclusive leading logic difference signals. The second logic gate output terminal 208 provides the exclusive lagging logic phase difference signals.

Referring again to FIG. 4, the phase output circuit means is characterized within phantom blocks 210 and 260 as being responsive to the exclusive leading logic phase difference signals, such as 85 or 91. The phase output circuit means, has within phantom block 210, a bi-polar circuit means for providing the average phase output signal of a first polarity. The averaged phase output signal is represented by waveforms 92 and 93. Waveform 92 represents a positive going signal in response to the exclusive leading logic phase difference signals 85. Waveform 93 represents an averaged phase output signal of a second polarity, a negative going signal in response to the exclusive lagging logic phase difference signals 91.

The circuit within phantom block 260 represents a means for monitoring the averaged phase output signal at node 219 in relation to a predetermined acceptable voltage band limit, such as the voltage band between the voltage at node 226 and the voltage a ground 300. The operator obtains notice of relative timing error as the bi-polar phase output signal at node 219 penetrates the limits established by the predetermined band. Potentiometer 256 is adjusted to attenuate the amplitude of the signal at node 212 to the amplitude required at node 219.

Referring again to FIG. 3, the reset circuit means is shown using a one-shot integrated circuit, such as 207, having first and second inputs 237, 238 and an output at node 209. The first and second inputs 237, 238 are coupled to respective first and second comparator output terminals 227, 229.

The one-shot 207 is set to provide a reset logic signal at its output 209 having a first polarity in response to the first logic signal at its first or second input 237, 238 to have a first logic state. The one-shot 207 is characterized to transfer from a reset state to a set or timed state as the first left or right threshold penetrating logic signals 78, 79, in each pair of logic signals 71, 73, translates in response to each pair of conditioned attenuated ignition signals. The reset logic signal 95 has a predetermined duration characterized to define the maximum time difference between the left and right threshold penetrating ignition signals.

The reset logic signal is coupled to a clear circuit means comprised of dc blocking capacitor 253, resistor 251 and diode 252. This clear circuit means circuit is responsive to the reset logic signal at node 209 and provides a simultaneous reset signal to reset the first and second flip-flops.

In a more particular embodiment, gates 247 and 248 are two input AND gates, such as those in a conventional TI 74LS08.

In another alternative embodiment of the dual ignition performance monitor circuit of FIG. 3, the first channel means is characterized as coupling the repeating series of sets of sequential amplitude difference signals at node 136 to a commutating means, shown as block 160 having an output terminal at node 146, for repeatedly selecting a predetermined selected amplitude difference signal from each set of amplitude difference signals and coupling the selected amplitude difference signal to the output terminal 146.

In this embodiment of the invention monitor circuit, the circuitry within phantom block 140 and to the right of block 160, and the circuits in phantom block 150 in FIG. 4 characterizes an embodiment of a detection and filter circuit means coupled to the commutating means output terminal 146. This circuit functions, as in the previous embodiment, by responding to the selected amplitude difference signals and conditioning the series of selected amplitude difference signals at node 146 to provide a conditioned commutated difference signal at node 156. The predetermined reference voltage is present at node 157 in FIG. 4. Potentiometer 152 provides a scaled commutated difference signal at node 153.

The circuit within phantom block 150 in FIG. 4 provides additional scaling and functions to compare the conditioned commutated difference signal with a predetermined amplitude reference signal, such as the voltage at node 157, and provides an ignition amplitude signal, such as a logic level at node 162 or a warning by lighting LED 164.

Figure 5:
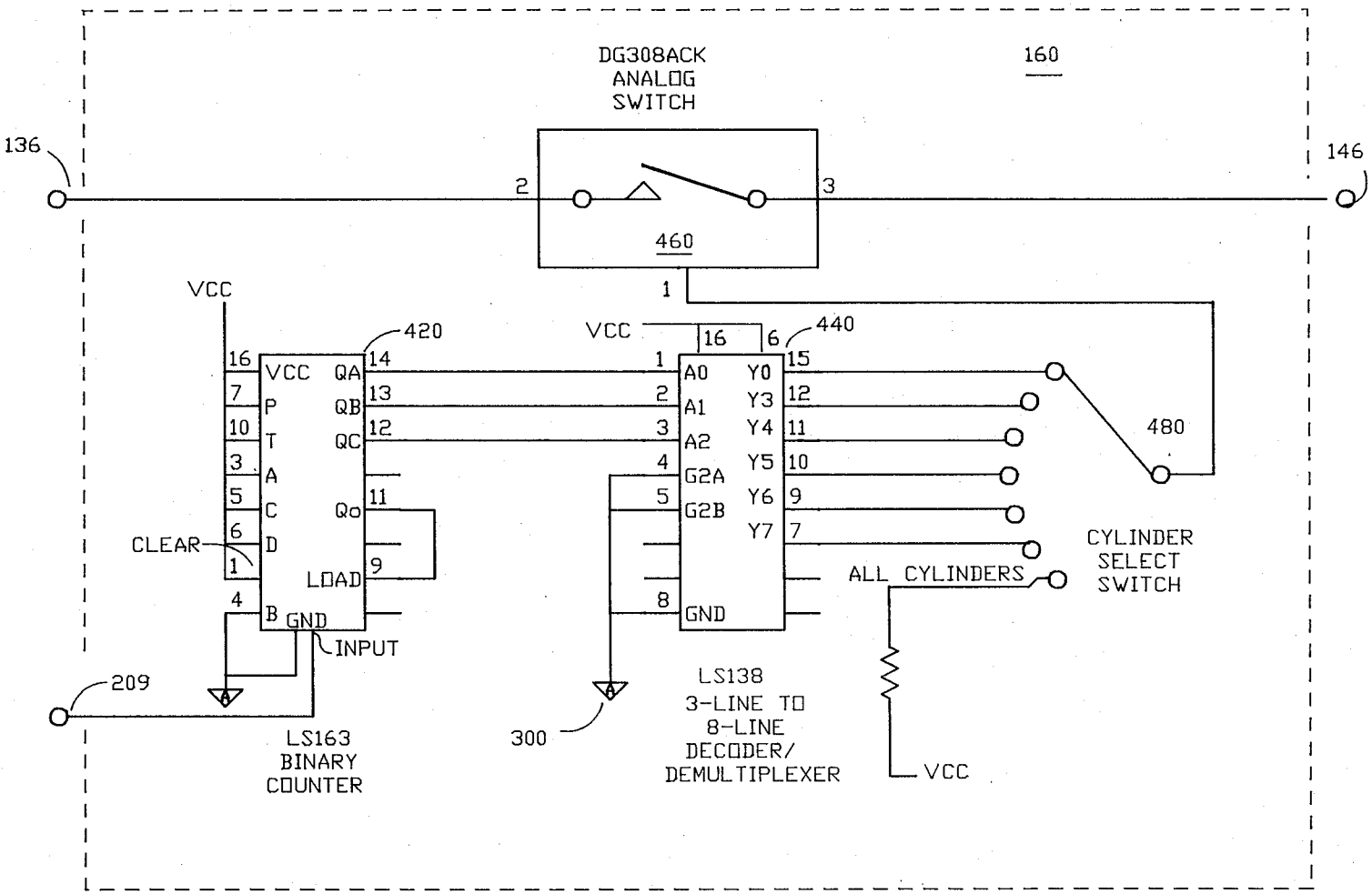
FIG. 5 is a schematic for a commutating circuit to enable the invention circuit, under operator or other control, to continuously select any pair of firing signals in the firing sequence for monitoring.

FIG. 5 shows an embodiment of a circuit to function as the commutating means that is represented by block 160 in FIG. 3. The commutating means has an analogue switch, such as 460. The analogue switch has an input coupled to node 136 to receive the repeating series of sets of sequential amplitude difference signals. The analogue switch 460 is controlled by a predetermined select control signal coupled from the common terminal of switch 480 to its pin 1 control signal input. The select control signal is a gated logic signal having a first and second logic level. The analogue switch couples a predetermined selected amplitude difference signal from each set of sequential amplitude difference signals to its output terminal 146.

The commutating means 160 has a select control circuit means, such as the circuit formed by the cylinder select switch 480, the binary counter 420, decoder 440 and cylinder select switch 480, and the circuits from FIG. 3 contained within phantom blocks 230 and the reset circuit of one-shot 207. The select control circuit formed by these elements is responsive to the left and right conditioned attenuated signals, for timing and synchronization and for providing the predetermined select control signal for each set of sequential amplitude difference signals to pin 1 of the analogue switch.

The select control circuit means 160 is also responsive to an operator initiated control signal, i.e. via positioning the select control switch 480, to cause the select control signal logic level to occur exclusively during intervals limited to the presence of the operator designated repeating predetermined amplitude difference signal in each set. The predetermined select control signal has a second logic level at all other times. The functional requirement relating to operator selection of the operator initiated control signal is obtained by use of selector switch 480.

The analogue switch circuit 460 is responsive to the predetermined select control signal first logic level for coupling the sets of analogue difference signals to the commutating means output terminal at 146 in response to the predetermined select control signal first logic level.

The commutating means select control circuit has a synchronizing circuit means responsive to the left and right conditioned attenuated ignition signals penetrating a predetermined threshold for providing a synchronizing signal. Synchronization signals are obtained from the reset circuit one-shot output at node 209. The one-shot is set by the first left and right threshold penetrating ignition signals in each pair of left and right signals from the outputs of the circuitry of phantom block 230 characterized above as means responsive to each relatively concurrent pair of left and right conditioned attenuated ignition signals for providing pairs of respective left and right threshold penetrating ignition signals.

FIG. 5 shows that the commutating means select control circuit includes a counter circuit means, such as the binary counter circuit 420. The counter circuit 420 is responsive to each synchronizing signal from the one-shot output at node 209 for repetitively providing sets of serial synchronized logic signals having a first and second logic state. Each set of signals characterizes a monotonic, repeating series, of binary numbers. The number of binary numbers in each set is equal to the number of pairs of left and right conditioned attenuated ignition signals in each serial set of conditioned attenuated ignition signals. For the purpose of illustration, if the engine being monitored by the invention ignition monitor circuit is a six cylinder engine, the counter circuit 420 will typically have six (6) unique states.

The commutating means select control circuit of FIG. 5 select switch 480 has a plurality of select switch terminals. Each select switch terminal 481, 482, 483 . . . corresponds to a binary number count in the monotonic repeating series. The position of common terminal 488 is controlled by the operator. By rotating the switch 480 common terminal 488 to couple to a predetermined switch position such as 481 or 482 or 483 through 486 for a six cylinder system, the operator establishes an exclusive conductive path from the common terminal to select switch terminal selected by the operator. The invention monitor circuit is not synchronized to a particular cylinder. The operator selects each of the cylinders for test and evaluation without knowing which amplitude reading is associated with which cylinder. However, the operator can compare the individual amplitude readings with each other and thereby obtain an indication of a completely failed cylinder reading or of a degraded reading.

The commutating means select control circuit of FIG. 5 also includes a decoder circuit means characterized by decoder 440. The decoder 440 is responsive to each counter circuit means set of serial synchronized logic signals for providing a discrete logic signal of a first logic level at each select switch terminal corresponding to a binary number count in the monotonic repeating series. Each discrete logic signal has a second logic level during intervals characterized by non-corresponding binary number counts in the monotonic repeating series. The discrete logic signals are provided by the outputs of the decoder 440 to the select switch terminals 481, 482, . . . 486 in sequence, the sequence repeating over and over again.

The analogue switch predetermined select control is obtained from the discrete signal present at the select switch common terminal 488. The predetermined select control signal from 488 closes the analogue switch to couple the difference amplifier output terminal at node 136 to the analogue switch output terminal at node 146 only during an interval corresponding to an operator designated selected amplitude difference signal.

The terminal designated as 487 on select switch 488 provides a continuous signal to pin 1 of analogue switch 460 holding analogue switch closed for all binary counts of counter 209. This position of select switch converts this embodiment of the circuit into an embodiment equivalent to the embodiment described above that functioned with the commutating means 160 closed and that detected the magnitude of the largest difference signal. The embodiment having a commutating means 160 permits the operator to examine the amplitude difference signal associated with each of the six cylinders without knowing which difference signal is associated with which cylinder.

The detection and filter circuit means of phantom blocks 140 and 150 has a detection circuit means, such as the circuit in phantom block 140, exclusive of the function block 160, responsive to the predetermined selected amplitude difference signals node 146 for detecting the series of selected amplitude difference signals and providing a detected commutated difference signal at node 153.

The detection and filter circuit means of phantom blocks 140 and 150 also has a conditioning circuit means, such as the circuit within phantom block 150. The conditioning circuit means 150 is responsive to the detected commutated difference signal at node 153 for conditioning and scaling the detected commutated difference signals to provide the conditioned commutated difference signal at node 156 in FIG. 4. The circuit also scales and compares the conditioned commutated difference signal at node 156 with the predetermined amplitude reference signal at node 157 and provides the ignition amplitude signal at node 162.

FIG. 3, phantom block 140 shows an embodiment of the detection circuit means that has a first terminal coupled to the commutating means output terminal 146 and a second terminal 153. The detection circuit means has a first and second capacitor C3, C4. Each respective capacitor has a first and second terminal. The detection circuit means also has a first and second diode CR1, CR2. Each respective diode has respective cathode and anode terminal.

The first diode cathode and the second diode anode are coupled to the first capacitor second terminal. The first capacitor first terminal is coupled to the commutating means output terminal. The first diode anode and the second capacitor second terminal 148 are coupled to the reference potential, ground 300. The second diode cathode is coupled to the second capacitor first terminal 151 and to the detection circuit means second terminal. The detected commutated difference signal at node 153 is provided at the detection circuit second terminal 153.

The conditioning circuit means is responsive to the detected commutated difference signal for conditioning and scaling the detected commutated difference signals to provide the conditioned commutated difference signal at node 153 for scaling and comparing the conditioned commutated difference signal at node 156 with the predetermined amplitude reference signal at node 157 and for providing the ignition amplitude signal at 162. Within phantom block 150, amplifier 154 is a typical high gain operational amplifier such as the uA741. Integrated circuit 158 is a conventional comparator such as the LM311. Integrated circuit 159 is a conventional LED driver.

The description thus provided is intended to be illustrative only and is not intended to be limitative. Those skilled in the art may conceive of modifications to the figures disclosed. However, any such modifications which fall within the purview of the description are intended to be included therein as well. The scope of this invention shall be determined from the scope of the following claims including their equivalents.

We claim:

1. A dual ignition performance monitor circuit for use by an operator, the invention circuit being coupled to a reciprocating internal combustion engine having a predetermined number of cylinders, each cylinder having a left and right spark plug, a left ignition system providing ignition firing signals to each respective left spark plug in a predetermined sequence and a right ignition system providing ignition firing signals to each respective right spark plug in a predetermined sequence, said left ignition system having a left signal line providing a left attenuated ignition signal and said right ignition system having a right signal line providing a right attenuated ignition signal, said attenuated left and right ignition signals forming a recurrent series of relatively concurrent left and right attenuated ignition signal pairs, said ignition signal pairs corresponding in number to said predetermined number of cylinders, each respective left and right attenuated ignition signal corresponding to the ignition firing signal applied to the respective engine spark plug in operation, said ignition performance monitor circuit comprising:

means for conditioning and scaling said left and right attenuated ignition signals and for providing respective left and right conditioned attenuated ignition signals;

first channel means having first and second inputs, said first and second inputs being coupled respectively to said left and right conditioned attenuated ignition signals for measuring the relative peak amplitude of the algebraic difference between relatively concurrent left and right conditioned attenuated ignition signals and for providing a repeating series of amplitude difference signals, each amplitude difference signal corresponding in sequence to a respective ignition signal pair and corresponding in peak amplitude to the algebraic difference between the left and right conditioned attenuated ignition signals forming the respective ignition signal pair;

means responsive to said amplitude difference signals for conditioning said series of amplitude difference signals and for scaling and comparing said amplitude difference signal with a predetermined amplitude reference signal and for providing an ignition amplitude signal;

second channel means having first and second inputs coupled respectively to said left and right conditioned attenuated ignition signals for measuring the relative time difference between said left and right conditioned attenuated ignition signals, and for providing a repeating series of phase difference signals, each phase difference signal corresponding to the time difference between relatively concurrent left and right conditioned attenuated ignition signals;

means responsive to said repeating series of phase difference signals for averaging and scaling said repeating series of phase difference signals and providing a timing signal characterizing the averaged relative phase difference signal in relation to a predetermined phase reference signal;

whereby, degradation in said dual ignition system is monitored by observing the magnitude of said ignition amplitude signal indicating the difference between the amplitude difference signal and said predetermined amplitude reference signal, and by observing the magnitude of said phase difference signal with respect to said predetermined phase reference signal.

2. The circuit of claim 1, wherein said first channel means further comprises:

a difference amplifier having an inverting input and a non-inverting input, and an output terminal, each respective input being coupled to receive a respective left and right conditioned attenuated ignition signals, said difference amplifier being characterized as amplifying the difference between said left and right conditioned attenuated ignition signals, and providing said said amplitude difference signals at said difference amplifier output terminal.

3. The circuit of claim 2, further comprising:

a means responsive to said amplitude difference signal for selecting the largest recurrent amplitude difference signal from said repeating recurrent series of amplitude difference signals, and for providing a largest amplitude difference signal corresponding in amplitude to said largest recurrent amplitude difference signal;

means responsive to said largest recurrent amplitude difference signal for conditioning said series of largest amplitude difference signals and for scaling and for comparing said largest amplitude difference signal with a predetermined amplitude reference signal and for providing an ignition amplitude signal.

4. The circuit of claim 3, wherein said first channel means responsive to said amplitude difference signal for selecting the largest recurrent amplitude difference signal from said repeating recurrent series of amplitude difference signals, and for providing a largest amplitude difference signal corresponding in amplitude to said largest recurrent amplitude difference signal further comprises:

a first channel first and second capacitor each respective first and second capacitor having a first and second terminal;

a first channel first and second diode, each respective diode having a cathode and anode terminal, said first diode cathode and said second diode anode being coupled to said first capacitor second terminal, said first capacitor first terminal being coupled to said difference amplifier output terminal, said first diode anode and said second capacitor second terminal being coupled to said reference potential, said second diode cathode being coupled to said second capacitor first terminal and to said means responsive to said amplitude difference signals for conditioning said series of amplitude difference signals and for scaling and comparing said amplitude difference signals with a predetermined amplitude reference signal and for providing an ignition amplitude signal, said series of largest recurrent difference signal being provided at said second capacitor first terminal.

5. The circuit of claim 4 further comprising:

a means for monitoring the value of said ignition amplitude signal.

6. The circuit of claim 1 wherein said second channel means having first and second inputs coupled respectively to said left and right conditioned attenuated ignition signals for measuring the relative time difference between said left and right conditioned attenuated ignition signals, and for providing a repeating series of phase difference signals, each phase difference signal corresponding to the time difference between relatively concurrent left and right conditioned attenuated ignition signals further comprises:

a means responsive to each relatively concurrent pair of said left and right conditioned attenuated ignition signals for providing pairs of respective left and right threshold penetrating ignition signals in response to said left and right conditioned attenuated ignition signals penetrating a predetermined threshold voltage, means responsive to said left and right threshold penetrating ignition signals for providing exclusive leading logic phase difference signals or lagging logic phase difference signals, phase output circuit means responsive to said exclusive repeating series of leading logic phase difference signals for providing an averaged phase output signal of a first polarity and responsive to said repeating series of lagging logic phase output signals for providing an averaged phase output signal of a second polarity, and means for monitoring said averaged phase output signal in relation to a predetermined acceptable limit band;

whereby said operator obtains notice of relative timing error.

7. The circuit of claim 6 wherein said a means responsive to each relatively concurrent pair of said left and right conditioned attenuated ignition signals for providing pairs of respective left and right threshold penetrating ignition signals further comprises:

a first and second comparator circuit, said first comparator circuit having a signal input coupled to said second channel means first input, said second comparator circuit having a signal input coupled to said second channel means second input, each comparator circuit having a respective reference signal input being coupled to a reference threshold voltage source, said first and second comparator circuits each having an output terminal, said first and second comparator circuits being characterized to provide respective left and right threshold penetrating ignition signals at each respective comparator output terminal as logic signal having a first logic state in response to a respective left or right conditioned attenualted ignition signal exceeding said predetermined reference threshold voltage source, and a second logic state in response to a respective left or right conditioned attenualted ignition signal voltage at its respective signal input not exceeding said predetermined reference threshold voltage.

8. The circuit of claim 7 wherein said means responsive to said left and right threshold penetrating ignition signals for providing respective exclusive leading logic phase difference signals or lagging logic phase difference signals further comprises:

a first and second flip-flop, said first flip-flop being set by said signal from said first comparator output terminal and said second flip-flop being set by a logic signal from said second comparator output terminal;

each respective flip-flop providing respective output signals at respective uncomplimented and complemented output terminals;

reset circuit means responsive to the onset of the first of each left and right threshold penetrating ignition signals in each pair assuming a first logic state for simultaneously resetting said first and second flip-flops after a predetermined time interval;

logic circuit means responsive to said first and second flip-flop outputs for providing said exclusive leading logic difference signals and said exclusive lagging logic difference signals.

9. The logic circuit means of claim 8 further comprising:

a first and second logic gate, each respective logic gate having a first and second input and an output terminal, said first logic gate first input being coupled to said first flip-flop uncomplimented output terminal, said first logic gate second input being coupled to said second flip-flop complemented output terminal, said second logic gate first input being coupled to said first flip-flop complemented output terminal, said second logic gate second input being coupled to said second flip-flop uncomplimented output, said first logic gate output terminal providing said exclusive leading logic difference signals and said second logic gate output terminal providing said exclusive lagging logic difference signals.

10. The circuit of claim 6 wherein said phase output circuit means responsive to said exclusive leading logic phase difference signals for providing an averaged phase output signal of a first polarity and responsive to said lagging logic phase output signals for providing an averaged phase output signal of a second polarity further comprises:

a bi-polar circuit means for providing said averaged phase output signal of a first polarity in response to said exclusive leading logic phase difference signals and for providing said averaged phase output signal of a second polarity in response to said exclusive lagging logic phase difference signals, and means for monitoring said averaged phase output signal in relation to a predetermined acceptable voltage band limit;

whereby, said operator obtains notice of relative timing error upon said bi-polar phase output signal penetrating the limits established by said predetermined band.

11. The circuit of claim 8 wherein said reset circuit means further comprises:

a one-shot circuit signal having first and second inputs, and an output, said first and second inputs being respectively coupled to respective first and second comparator output terminals, said one-shot being set to provide a reset logic signal at its output having a first polarity in response to the first logic signal at its first or second input to have a first logic state, said reset logic signal having a predetermined duration characterized to define the maximum time difference between said left and right threshold penetrating ignition signals, clear circuit means responsive to said reset logic signal termination for providing a simultaneous reset signal to reset said first and second flip-flops.

12. The circuit of claim 9 wherein said first and second logic gates are AND gates.

13. A dual ignition performance monitor circuit for use by an operator, the invention circuit being coupled to a reciprocating internal combustion engine having a predetermined number of cylinders, each cylinder having a left and right spark plug, a left ignition system providing ignition firing signals to each respective left spark plug in a predetermined sequence and a right ignition system providing ignition firing signals to each respective right spark plug in a predetermined sequence, said left ignition system having a left signal line providing a left attenuated ignition signal and said right ignition system having a right signal line providing a right attenuated ignition signal, said attenuated left and right ignition signals forming a recurrent series of relatively concurrent left and right attenuated ignition signal pairs, said ignition signal pairs corresponding in number to said predetermined number of cylinders, each respective left and right attenuated ignition signal corresponding to the ignition firing signal applied to the respective engine spark plug in operation, said ignition performance monitor circuit comprising:

means for conditioning and scaling said left and right attenuated ignition signals and for providing respective left and right conditioned attenuated ignition signals;

first channel means having first and second inputs, said first and second inputs being coupled respectively to said left and right conditioned attenuated ignition signals for measuring the relative peak amplitude of the algebraic difference between relatively concurrent left and right conditioned attenuated ignition signals and for providing a repeating series of sets of sequential amplitude difference signals, each amplitude difference signal corresponding in sequence to a respective ignition signal pair and corresponding in peak amplitude to the algebraic difference between the left and right conditioned attenuated ignition signals forming the respective ignition signal pair;

commutating means having an output terminal for repeatedly selecting a predetermined selected amplitude difference signal from each set of amplitude difference signals and coupling the selected amplitude difference signal to said output terminal, detection and filter circuit means coupled to said commutating means output terminal and responsive to said selected amplitude difference signals for detecting and conditioning said series of selected amplitude difference signals to provide a conditioned commutated difference signal and for scaling and comparing said conditioned commutated difference signal with a predetermined amplitude reference signal and for providing an ignition amplitude signal;

second channel means having first and second inputs coupled respectively to said left and right conditioned attenuated ignition signals for measuring the relative time difference between said left and right conditioned attenuated ignition signals, and for providing a repeating series of phase difference signals, each phase difference signal corresponding to the time difference between relatively concurrent left and right conditioned attenuated ignition signals;

means responsive to said repeating series of phase difference signals for averaging and scaling said repeating series of phase difference signals and providing a timing signal characterizing the averaged relative phase difference signal in relation to a predetermined phase reference signal;

whereby, degradation in said dual ignition system is monitored by observing the magnitude of said ignition amplitude signal indicating the difference between the largest amplitude difference signal and said predetermined amplitude reference signal, and by observing the magnitude of said phase difference signal with respect to said predetermined phase reference signal.

14. The circuit of claim 13, wherein said first channel means further comprises:

a difference amplifier having an inverting input and a non-inverting input, and an output terminal, each respective input being coupled to receive a respective left and right conditioned attenuated ignition signals, said difference amplifier being characterized as amplifying the difference between said left and right conditioned attenuated ignition signals, and providing said series of sets of said sequential amplitude difference signals at said difference amplifier output terminal.

15. The circuit of claim 14, whereby said commutating means further comprises:

an analogue switch circuit having an input coupled to receive said repeating series of sets of sequential amplitude difference signals, and an output coupled to said, commutating means output terminal for coupling said predetermined selected amplitude difference signal from each set of sequential amplitude difference signals to said output terminal, and select control circuit means responsive to said left and right conditioned attenuated signals for providing a predetermined select control signal for each set of sequential amplitude difference signals, said select control means being further characterized as being responsive to an operator initiated control signal to set said predetermined select control signal to a first logic level exclusively during intervals limited to the presence of said operator designated repeating predetermined selected amplitude difference signal in each set, said predetermined select control signal having a second logic level at all other times.

16. The circuit of claim 15, wherein said select control circuit means further comprises:

a synchronizing circuit means responsive to said left and right conditioned attenuated ignition signals penetrating a predetermined threshold for providing a synchronizing signal, counter circuit means responsive to each synchronizing signal for repetitively providing sets of serial synchronized logic signals having a first and second logic state, each set of signals characterizing a binary number in a monotonic repeating series, the number of binary numbers in each set being equal to the number of pairs of left and right conditioned attenuated ignition signals in each serial set of conditioned attenuated ignition signals, a select switch having a plurality of select switch terminals, eac select terminal corresponding to a binary number count in said monotonic repeating series, and a common terminal, said select switch being controlled by said operator, to provide an exclusive conductive path from said common terminal to select switch terminal selected by said operator, decoder circuit means responsive to each counter circuit means set of serial synchronized logic signals for providing a discrete logic signal of a first logic level at each select switch terminal corresponding to a binary number count in said monotonic repeating series, each said discrete logic signal having a second logic level during internals characterized by non-corresponding binary number counts in said monotonic repeating series, said analogue switch predetermined select control signal being further characterized as the discrete signal present at said select switch common terminal, whereby; said predetermined select control signal closes said analogue switch to couple said difference amplifier output terminal to said analogue switch output terminal only during an interval corresponding to an operator designated selected amplitude difference signal.

17. The circuit of claim 15, wherein said detection and filter circuit means coupled to said commutating means output terminal and responsive to said predetermined selected amplitude difference signals for detecting and conditioning said series of selected amplitude difference signals to provide a conditioned commutated difference signal and for scaling and comparing said conditioned commutated difference signal with a predetermined amplitude reference signal and for providing an ignition amplitude signal; further comprises:

a detection circuit means responsive to said predetermined selected amplitude difference signals for detecting the series of selected amplitude difference signals and providing a detected commutated difference signal, and conditioning circuit means responsive to said detected commutated difference signal and for conditioning and scaling said detected commutated difference signals to provide sid conditioned commutated difference signal and for scaling and comparing said conditioned commutated difference signal with said predetermined amplitude reference signal and for providing said ignition amplitude signal.

18. The detection circuit means of claim 17 further comprising:

a first terminal coupled to said commutating means output terminal, and a second terminal;

a first and second capacitor, each respective capacitor having a first and second terminal, a first and second diode, each respective diode having a cathode and an anode terminal, said first diode cathode and said second diode anode being coupled to said first capacitor second terminal, said first capacitor first terminal being coupled to said difference amplifier output terminal, said first diode anode and said second capacitor second terminal being coupled to said reference potential, said second diode cathode being coupled to said second capacitor first terminal and to said detection circuit means second terminal, said detected commutated difference signal being provided at said detection circuit second terminal, said conditioning circuit means being responsive to said detected commutated difference signal for conditioning and scaling said detected commutated difference signals to provide said conditioned commutated difference signal and for scaling and comparing said conditioned commutated difference signal with said predetermined amplitude reference signal and for providing said ignition amplitude signal.

19. The circuit of claim 12 wherein said second channel means having first and second inputs coupled respectively to said left and right conditioned attenuated ignition signals for measuring the relative time difference between said left and right conditioned attenuated ignition signals, and for providing a repeating series of phase difference signals, each phase difference signal corresponding to the time difference between relatively concurrent left and right attenuated ignition signals further comprises:

a means responsive to each relatively concurrent pair of said left and right conditioned attenuated ignition signals for providing pairs of respective left and right threshold penetrating ignition signals in response to said left and right conditioned attenuated ignition signals penetrating a predetermined threshold voltage, means responsive to said left and right threshold penetrating ignition signals for providing exclusive leading logic phase difference signals or lagging logic phase difference signals, phase output circuit means responsive to said exclusive repeating series of leading logic phase difference signals for providing an averages phase output signal of a first polarity and responsive to said repeating series of lagging logic phase output signals for providing an averaged phase output signal of a second polarity, and means for monitoring said averaged phase output signal in relation to a predetermined acceptable limit band;

whereby said operator obtains notice of relative timing error.

20. The circuit of claim 19 wherein said means responsive to each relatively concurrent pair of said left and right conditioned attenuated ignition signals for providing pairs of respective left and right threshold penetrating ignition signals further comprises:

a first and second comparator circuit, said first comparator circuit having a signal input coupled to said second channel means first input, said second comparator circuit having a signal input coupled to said second channel means second input, each comparator circuit having a respective reference signal input being coupled to a reference threshold voltage source, said first and second comparator circuits each having an output terminal, said first and second comparator circuits being characterized to provide respective left and right threshold penetrating ignition signals at each respective output terminal as logic signal having a first logic state in response to a respective left or right conditioned attenualted ignition signal exceeding said predetermined reference threshold voltage source, and a second logic state in response to a respective left or right conditioned attenualted ignition signal voltage at its respective signal input not exceeding said predetermined reference threshold voltage.

21. The circuit of claim 20 wherein said means responsive to said left and right threshold penetrating ignition signals for providing respective exclusive leading logic phase difference signals or lagging logic phase difference signals further comprises:

a first and second flip-flop, said first flip-plop being set by said signal from said first comparator output terminal and said second flip-flop being set by a logic signal from said second comparator output terminal;

each respective flip-flop providing respective output signals at respective uncomplemented and complemented output terminals;

reset circuit means responsive to the onset of the first of each left and right threshold penetrating ignition signals in each pair assuming a first logic state for simultaneously resetting said first and second flip-flops after a predetermined time interval;

logic circuit means responsive to said first and second flip-flop outputs for providing said exclusive leading logic difference signals and said exclusive lagging logic difference signals.

22. The logic circuit means of claim 21 further comprising:

a first and second logic gate, each respective logic gate having a first and second input and an output terminal, said first logic gate first input being coupled to said first flip-flop uncomplimented output terminal, said first logic gate second input being coupled to said second flip-flop complemented output terminal, said second logic gate first input being coupled to said first flip-flop complemented output terminal, said second logic gate second input being coupled to said second flip-flop uncomplimented output, said first logic gate output terminal providing said exclusive leading logic difference signals and said second logic gate output terminal providing said exclusive lagging logic difference signals.

23. The circuit of claim 19 wherein said phase output circuit means responsive to said exclusive leading logic phase difference signals for providing an averaged phase output signal of a first polarity and responsive to said lagging logic phase output signals for providing an averaged phase output signal of a second polarity further comprises:

a bi-polar circuit means for providing said averaged phase output signal of a first polarity in response to said exclusive leading logic phase difference signals and for providing said averaged phase output signal of a second polarity in response to said exclusive lagging logic phase difference signals, and means for monitoring said averaged phase output signal in relation to a predetermined acceptable voltage band limit;

whereby, said operator obtains notice of relative timing error upon said bi-polar phase output signal penetrating the limits established by said predetermined band.

24. The circuit of claim 20 wherein said reset circuit means further comprises:

a one-shot circuit signal having first and second inputs, and an output, said first and second inputs being respectively coupled to respective first and second comparator output terminals, said one-shot being set to provide a reset logic signal at its output having a first polarity in response to the first logic signal at its first or second input to have a first logic state, and reset logic signal having a predetermined duration characterized to define the maximum time difference between said left and right threshold penetrating ignition signals, clear circuit means responsive to said reset logic signal termination for providing a simultaneous reset signal to reset said first and second flip-flops.

25. The circuit of claim 22 wherein said first and second logic gates are nand gates.

* * * * *